US006079642A

United States Patent [19]

Maier

[11] Patent Number: 6,079,642

[45] Date of Patent: Jun. 27, 2000

[54] FUEL INJECTION VALVE AND METHOD FOR PRODUCING A VALVE NEEDLE OF A FUEL INJECTION VALVE

[75] Inventor: Dieter Maier, Gerlingen, Germany

[73] Assignee: Robert Bosch GmbH, Stuttgart, Germany

[21] Appl. No.: 09/180,126

[22] PCT Filed: Dec. 11, 1997

[86] PCT No.: PCT/DE97/02879

§ 371 Date: Nov. 2, 1998

§ 102(e) Date: Nov. 2, 1998

[87] PCT Pub. No.: WO98/42975

PCT Pub. Date: Oct. 1, 1998

[30] Foreign Application Priority Data

Mar. 26, 1997 [DE] Germany ..... 197 12 589

[51] Int. Cl.[7] ..... B05B 1/30; F02M 51/00

[52] U.S. Cl. ..... 239/585.1; 239/585.3; 239/585.4; 239/900

[58] Field of Search ..... 239/585.1–585.5, 239/584, 900, 1, 5; 251/129.15, 129.21; 29/890.12, 890.123, 890.13, 890.142, 890.143

[56] References Cited

U.S. PATENT DOCUMENTS

| | | | |
|---|---|---|---|
| 4,060,199 | 11/1977 | Brune et al. | 239/585.5 X |
| 4,481,699 | 11/1984 | Knapp et al. | 239/585.3 X |
| 4,742,964 | 5/1988 | Ito et al. | 239/585.4 X |
| 4,790,351 | 12/1988 | Kervagoret . | |
| 5,613,640 | 3/1997 | Furuya et al. | 239/585.5 |
| 5,704,553 | 1/1998 | Wieczorek et al. | 239/585.1 |
| 5,803,369 | 9/1998 | Toyao et al. | 239/585.1 X |
| 5,820,032 | 10/1998 | Reiter | 239/585.1 |
| 5,884,850 | 3/1999 | Norgauer | 239/585.5 |

FOREIGN PATENT DOCUMENTS

| | | |
|---|---|---|
| 33 18 486 | 2/1984 | Germany . |
| 38 08 635 | 9/1989 | Germany . |
| 40 08 675 | 9/1991 | Germany . |
| 195 03 224 | 8/1996 | Germany . |
| 2 213 203 | 8/1989 | United Kingdom . |

*Primary Examiner*—Andres Kashnikow
*Assistant Examiner*—Steven J. Ganey
*Attorney, Agent, or Firm*—Kenyon & Kenyon

[57] ABSTRACT

A fuel injection valve includes an axially movable valve needle which has at least a closure element support and a spherical valve closure element. The closure element support receives the valve closure element in a lower recess. An end region of the closure element support fits around the valve closure element in the downstream direction beyond an equator of the valve closure element. The immovable join between valve closure element and closure element support is achieved by crimping. The fuel injection valve is particularly suitable for use in fuel injection systems of mixture-compressing spark-ignited internal combustion engines.

11 Claims, 2 Drawing Sheets

FUEL INJECTION VALVE AND METHOD FOR PRODUCING A VALVE NEEDLE OF A FUEL INJECTION VALVE

BACKGROUND INFORMATION

An electromagnetically actuatable fuel injection valve, which has an axially movable valve needle as the closure element support for a spherical valve closure element, is described in German Patent Application No. 33 18 486. With a lower end region, the closure element support fits only partially around the valve closure elements, such that the enclosed region of the valve closure element extends at most only to its greatest diameter. The opening width of the recess receiving the valve closure element in the end region of the closure element support perpendicular to the longitudinal valve axis is thus at least as great as the greatest diameter of the valve closure element. A direct joining method, for example welding, soldering, or adhesive bonding, must be used to prevent the valve closure element from slipping out of the recess. If the recess and the valve closure element have the dimensions of a press fit, the valve closure element can also be retained by being pressed into the closure element support.

German Patent Application No. 195 03 224 describes an electromagnetically actuatable injection valve which has a valve needle whose closure element support, serving as the connecting part, is shaped from plastic. The spherical valve closure element and the closure element support are immovably joined to one another via a snap connection, the closure element support possessing resilient retaining jaws which fit around the valve closure element.

It has been known for some time, as is also evident from German Patent Application No. 40 08 675, to achieve immovable joins between individual components of valve needles in direct fashion, for example using weld beads.

Also known, from German Patent Application No. 38 08 635, is a fuel injection apparatus which has a valve needle having external helical grooves. The grooves delimited in the valve element form helical fuel channels which not only impart a swirl to the fuel, but also control the fuel flow velocity.

SUMMARY OF THE INVENTION

According to the present invention, a fuel injection valve can be manufactures particularly easily in an economical and reliably processed fashion. It is of particular advantage in this context that an extremely simple and economical and nevertheless very secure join between a closure element support and a spherical valve closure element can be attained. In this context, in order to fit securely around the valve closure element, the closure element support is shaped in an end region with a recess in such a way that the valve closure element penetrates into the recess, viewed in the axial direction, beyond its equator, i.e. the region of greatest radial extension. Attachment of the valve closure element is accomplished in that the end region constituting an annular retaining jaw is at least partially plastically deformed radially inward, using a crimping tool, in such a way that the opening width of the recess at its downstream end is less than the diameter of the valve closure element. A very reliable and durable connection to the valve needle is achieved without the use of a joining method to achieve a direct join.

The closure element support can be embodied as a cold-pressed part. Through openings can thereby be formed concurrently in simple fashion.

It is advantageous to configure grooves as fuel flow passages in helical form on the periphery of the valve needle. They allow a swirl to be applied to the fuel to improve its atomization.

DETAILED DESCRIPTION

Figure 1:
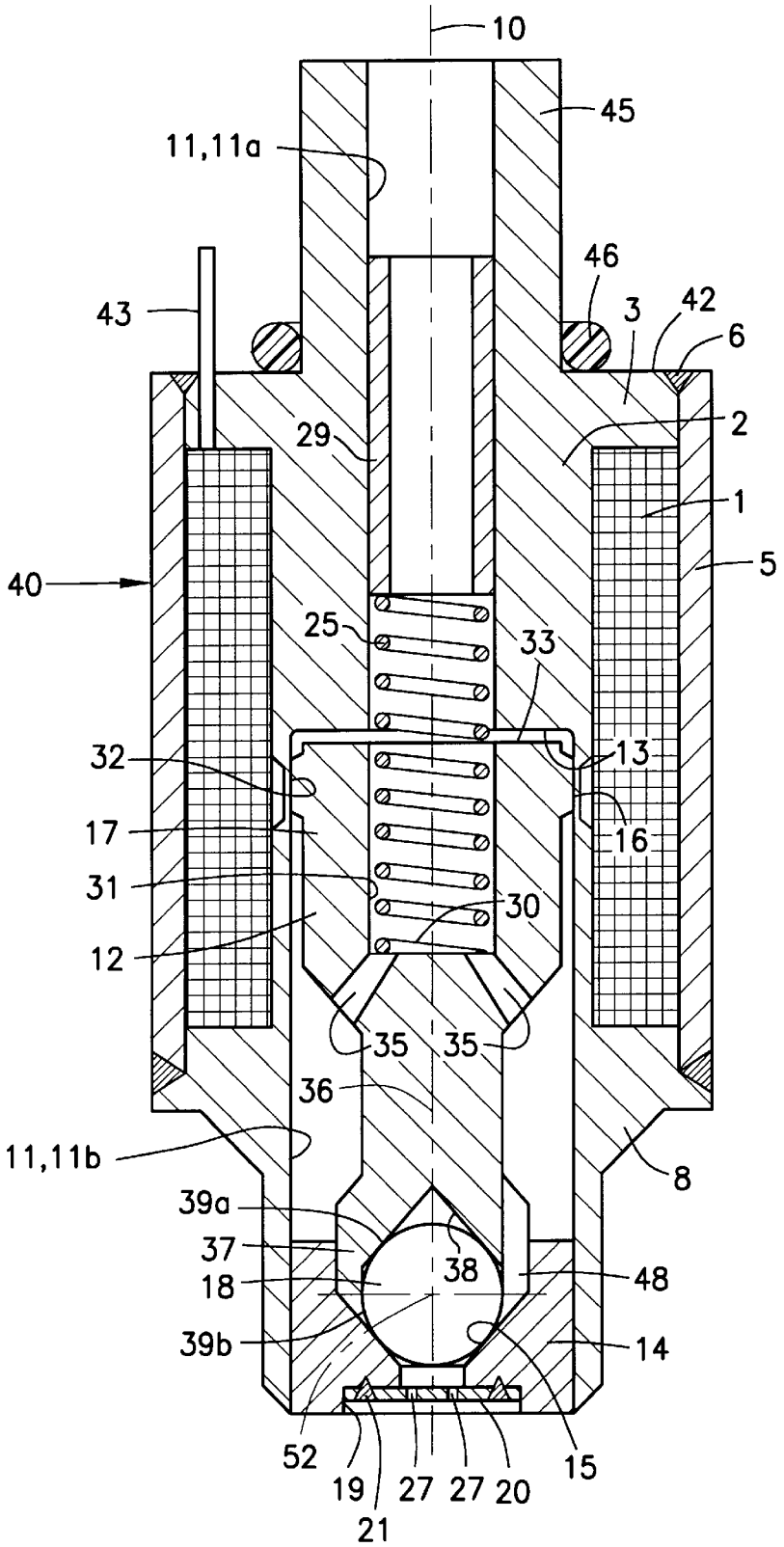
FIG. 1 shows a fuel injection valve according to the present invention.

The electromagnetically actuatable valve according to the present invention shown in exemplary and partially simplified fashion in FIG. 1, in the form of an injection valve for fuel injection systems of mixture-compressing, spark-ignited internal combustion engines, has a one-piece largely tubular metal base element 2 which is surrounded by a magnet coil 1 and serves as fuel inlet and passage and as the valve seat support. Base element 2 has multiple steps, and especially is of stepped configuration in the radial direction upstream from magnet coil 1, so that base element 2 partially envelops magnet coil 1 with an upper cover section 3, and makes possible a particularly compact design for the injection valve in the region of magnet coil 1. Magnet coil 1 is surrounded by an external, for example ferromagnetic valve shell 5 as the external pole, which completely surrounds magnet coil 1 in the circumferential direction and at its upper end is joined immovably to base element 2 at its cover section 3, for example via a weld bead 6. To close the magnetic circuit, base element 2 is also of stepped configuration downstream from magnet coil 1, thus forming a conductive section 8 which, like cover section 3, axially delimits magnet coil 1 and thereby constitutes the boundary of magnet coil region 1 toward the bottom or in the downstream direction.

Together with valve shell 5, base element 2 constitutes, by way of its two sections 3 and 8, an annular space receiving magnet coil 1. Base element 2 possesses an inner longitudinal opening 11, running concentrically with a longitudinal valve axis 10, which in an upstream region 11*a* serves as a fuel flow channel, and in a downstream region 11*b* additionally serves at least partially as a guide opening for a valve needle 12 which is axially movable along longitudinal valve axis 10. Region 11*b* has a greater diameter than region 11*a*, since a step 13 in longitudinal opening 11 is provided in the axial extension region of magnet coil 1. Following directly downstream from step 13, base element 2 possesses a thin-walled magnetic throttling point 16.

Downstream from conductive section 8, base element 2 functions as a valve seat support, since a valve seat element 14 which has an immovable valve seat surface 15 as valve seat is mounted at the downstream end of region 11*b* of longitudinal opening 11. Valve seat element 14 is immovably joined to base element 2 via a weld bead produced, for example, using a laser. Otherwise lower region 11*b* of longitudinal opening 11 serves to receive valve needle 12, which is constituted by an armature 17 and a spherical valve closure element 18. A flat perforated spray disk 20 is arranged at the downstream end face of valve seat element 14, for example in a recess 19, the immovable join between valve seat element 14 and perforated spray disk 20 being accomplished, for example, via a circumferential sealed weld bead 21. At its downstream end facing perforated spray disk 20, armature 17 which serves as the closure element support is immovably joined to spherical valve closure element 18, according to the present invention, by crimping.

Actuation of the injection valve is accomplished, in a conventional manner, electromagnetically. The electromagnetic circuit having magnet coil 1, inner core 2, outer valve shell 5, and armature 17 serves to move valve needle 12 axially and thus to open the injection valve against the spring force of a return spring 25 or to close it. Armature 17 is directed correspondingly toward core 2. Return spring 25 extends in longitudinal opening 11, for example, both downstream and upstream from step 13, i.e. into both regions 11*a* and 11*b*.

The spherical valve closure element 18 coacts with valve seat surface 15, which tapers in truncated conical fashion in the flow direction, of valve seat element 14 and is configured axially downstream from a guide opening in valve seat element 14. Perforated spray disk 20 possesses at least one, for example four spray discharge openings 27 shaped by electrodischarge machining or punching.

The insertion depth of valve seat element 14 in the injection valve is critical for, among other things, the stroke of valve needle 12. In this context, the one end position of valve needle 12, when magnet coil 1 is not energized, is defined by contact of valve closure element 18 against valve seat surface 15 of valve seat element 14, while the other end position of valve needle 12, when magnet coil 1 is energized, results from contact of armature 17 against step 13 of base element 2. The stroke is adjusted by an axial displacement of valve seat element 14, which is subsequently joined immovably to base element 2 in accordance with the desired position.

In addition to return spring 25, an adjusting sleeve 29 is inserted into upper region 11*a* of longitudinal opening 11. Adjusting sleeve 29 is used to adjust the spring preload of return spring 25 which rests against adjusting sleeve 29 and braces at its opposite end against a bottom region 30 of an internal depression 31 in closure element support 17; an adjustment of the dynamic spray discharge volume is also accomplished with adjusting sleeve 29.

Armature 17 has, for example in the axial extension region of magnetic throttling point 16 on the outer periphery, an annular upper guide surface 32 which serves to guide axially movable valve needle 12 in longitudinal opening 11. Closure element support 17, configured, for example, as a cold-pressed part, has an upper stop surface 33, facing step 13, which is equipped with a wear protection layer, for example is chrome-plated. Proceeding from bottom region 30 of depression 31 in closure element support 17 is at least one through opening 35; for example, two or four through openings 35 are shaped, extending outward obliquely with respect to valve axis 10. Closure element support 17 tapers in the downstream direction in the region of through openings 35, the outer contour being of truncated conical shape. This configuration of valve closure support 17 makes it possible for the fuel being delivered to valve seat surface 15 to flow in unimpeded fashion first through depression 31 inside valve closure support 17 and, after emerging from through openings 35, outside it. Through openings 35 may be configured in any desired shape (e.g. with circular, elliptical, or polygonal cross sections), and may extend axially, radially, or obliquely.

Figure 2:
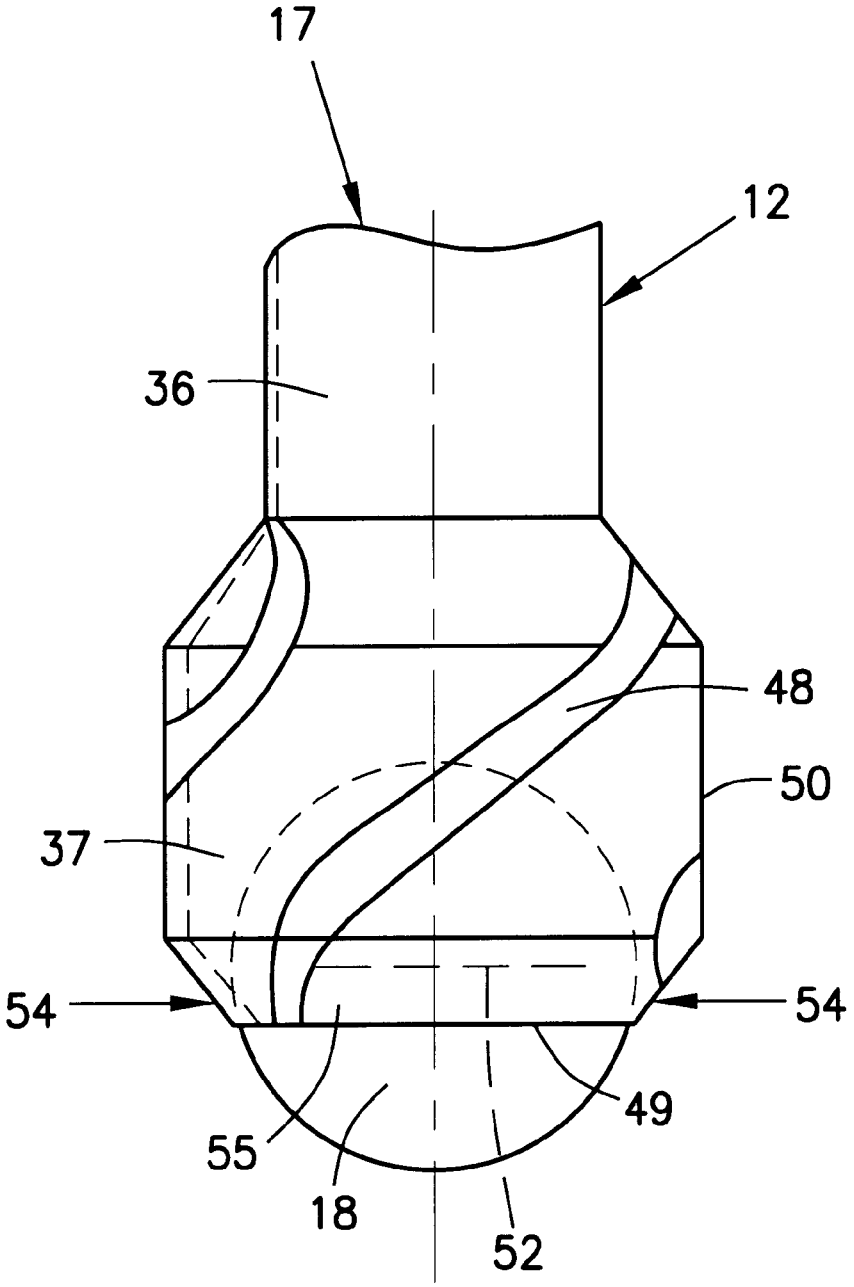
FIG. 2 shows an enlarged view of a valve needle manufactured according to the present invention.

Downstream from through openings 35, closure element support 17 is configured in solid form as needle shaft 36. As far as a downstream end region 37, needle shaft 36 has a largely constant outside diameter which, however, is much smaller than the outside diameter of the region, lying upstream, of closure element support 17 having internal depression 31. The lower end region 37 of closure element support 17 in turn possesses a greater outside diameter than needle shaft 36, the transition being, for example, of truncated conical shape. The function of end region 37 is to receive spherical valve closure element 18 in an internal recess 38, similar to a blind hole, which is recessed in from the lower side facing valve closure element 18. Recess 38 is configured, for example, with two axially successive sections 39*a* and 39*b*, upper section 39*a* facing magnet coil 1 being conical, and lower section 39*b* facing perforated spray disk 20 being configured in largely cylindrical fashion. In the assembled state, valve closure element 18 rests against the wall of conical section 39*a* at least in the form of a linear contact. FIG. 2 shows end region 37 of closure element support 17 at a different scale.

An injection valve of the design described above is characterized by its particularly compact design, resulting in a very small, manageable injection valve whose valve shell 5 has, for example, an outside diameter of only approximately 12 mm. The components described above constitute an independent preassembled assembly which may be called functional part 40. The completely adjusted and assembled functional part 40 has, for example, an upper end surface 42, in this case cover section 3, beyond which, for example, two contact pins 43 project. By way of electrical contact pins 43, which serve as electrical connecting elements, electrical contact is made to magnet coil 1 and it is thereby energized.

A connector part (not shown), which is characterized above all by the fact that it includes the electrical and hydraulic connections of the entire fuel injection valve, can be joined to a functional part 40 of this kind. When the injection valve is completely assembled, a hydraulic connection between the connector part (not shown) and functional part 40 is achieved in that flow bores of the two assemblies are brought together so that fuel can flow through in unimpeded fashion. In this context, for example, end surface 42 of functional part 40 then rests directly against a lower end surface of the connector part, and is immovably joined thereto. When the connector part is assembled onto functional part 40, a base element fitting 45 of base element 2, projecting beyond end surface 42 and thus beyond cover section 3, can project into a flow bore of the connector part in order to enhance the stability of the join. A sealing ring 46, for example, which surrounds base element fitting 45 and rests on end surface 42 of cover section 3, is provided in the joining region for secure sealing. In the completely assembled valve, contact pins 43 serving as electrical connection elements participate in a secure electrical connection with corresponding electrical connection elements of the connector part.

FIG. 2 shows the region of valve needle 12 in which closure element support 17 and valve closure element 18 are joined to one another. Recessed on the outer periphery of end region 37 are, for example, two, three, or a plurality of helical grooves 48 for the passage of fuel, which extend from the end of needle shaft 36 to lower boundary 49 of end region 37. Grooves 48 cause the fuel to be acted upon by a swirl component as it flows through, one of the results being improved atomization. In addition, it is possible to control the fuel flow velocity. The outer periphery of end region 37 outside grooves 48 can serve, in addition to upper guide surface 32, as a lower guide surface 50 for valve needle 12 in valve seat element 14.

In the plane of the lower boundary of end region 37, recess 38 possesses an opening width which is less than the diameter of valve closure element 18. Before attachment of valve closure element 18 to closure element support 17 is accomplished, lower section 39*b* of recess 38 is, for example, of completely cylindrical configuration, the diameter of section 39*b* corresponding approximately to the diameter of valve closure element 18 so that the latter can readily be introduced into recess 38 until it comes to a stop against section 39*a*. Valve closure element 18 is, in this context, placed sufficiently far into recess 38 that its equator 52, i.e. the region of greatest radial extension, lies within recess 38, and lower boundary 49 of end region 37 is located farther downstream.

This configuration makes it possible, by crimping, to achieve an extremely simple and economical and nevertheless reliable join between closure element support 17 and valve closure element 18. Attachment of valve closure element 18 is accomplished in that end region 37, which forms an annular retaining jaw in the region of recess 38, is at least partially plastically deformed radially inward using a crimping tool (not shown), with a direction of action according to arrow 54. Since the deformed region is only the very end of end region 37, the opening width of recess 38 is reduced most of all downstream from equator 52 of valve closure element 18. The material of end region 37 is displaced so that it fits around the spherical valve closure element 18 directly beneath equator 52. The opening width of recess 38 is thereafter, in the plane of boundary 49, less than the diameter of valve closure element 18, thus completely preventing valve closure element 18 from slipping out of recess 38. After the crimping tool has been applied, end region 37 has, for example, a conical lower delimiting surface 55 which can be interrupted by grooves 48.

Valve needle 12 is, for example, not accurately machined (ground) on its guide surfaces 32 and 50 and stop surfaces 33 until after crimping, in order to guarantee the desired dimensional and positional tolerances with high accuracy. Low tolerance fluctuations advantageously allow stable functional data when injection valves are manufactured in large production runs.

What is claimed is:

1. A fuel injection valve for a fuel injection system of an internal combustion engine, comprising:

an electromagnetic arrangement having an axially movable valve needle, the axially movable valve needle including a metal closure element support and a spherical valve closure element, the metal closure element support having a recess; and a fixed valve seat cooperating with the spherical valve closure element, wherein the recess is an opening substantially corresponding to a blind hole and extending along a longitudinal valve axis of the fuel injection valve, the recess having a lower section and an upper section, wherein the spherical valve closure element is engaged in the recess to form an immovable join between the spherical valve closure element and the metal closure element support, the immovable join being formed by a crimping procedure, and wherein the metal closure element support has a downstream end region, the downstream end region and the recess extending in a downstream direction beyond an equator of the spherical valve closure element.

2. The fuel injection valve according to claim 1 wherein the upper section has a conical shape, and the lower section has a substantially cylindrical shape.

3. The fuel injection valve according to claim 1 wherein the upper section provides a stop for the spherical valve closure element.

4. The fuel injection valve according to claim 1, wherein an opening width of the recess at a lower boundary of the downstream end region is smaller than a diameter of the spherical valve closure element.

5. The fuel injection valve according to claim 1, wherein the metal closure element support is a cold-pressed part.

6. The fuel injection valve according to claim 1, wherein the metal closure element support is a cold-formed part.

7. A fuel injection valve for a fuel injection system of an internal combustion engine, comprising:

an electromagnetic arrangement having an axially movable valve needle, the axially movable valve needle including a metal closure element support and a spherical valve closure element, the metal closure element support having a recess; and a fixed valve seat cooperating with the spherical valve closure element, wherein the spherical valve closure element is engaged in the recess to form an immovable join between the spherical valve closure element and the metal closure element support, the immovable join being formed by a crimping procedure, and wherein the metal closure element support has a downstream end region, the downstream end region including helical grooves situated at a periphery of the downstream end region, the helical grooves enabling a fuel to pass therethrough, the downstream end region and the recess extending in a downstream direction beyond an equator of the spherical valve closure element.

8. A method for manufacturing a valve needle of a fuel injection valve, comprising the steps of:

(a) manufacturing a metal closure element support and a spherical valve closure element, the metal closure element support having a recess that is an opening substantially corresponding to a blind hole and extending along a longitudinal valve axis of the fuel injection valve;

(b) introducing the spherical valve closure element having an equator into the recess, the equator being received within the recess; and (c) after step (b), plastically deforming the metal closure element support with a crimping tool to immovably join the spherical valve closure element to the metal closure element support.

9. The method according to claim 8, wherein the metal closure element support is a cold-pressed part.

10. The method according to claim 8, wherein the metal closure element support is a cold-formed part.

11. The method according to claim 8, wherein the metal closure element support and the spherical valve closure element are portions of a valve needle, the valve needle including guide surfaces and stop surfaces, and further comprising the step of:

(d) after step (c), finish-machining the guide surfaces and the stop surfaces of the valve needle.

* * * * *